US011603244B2

(12) United States Patent
Thompson et al.

(10) Patent No.: US 11,603,244 B2
(45) Date of Patent: Mar. 14, 2023

(54) PORTABLE COOLING MULTIPACK

(71) Applicant: Anheuser-Busch InBev S.A., Brussels (BE)

(72) Inventors: Keenan Thompson, Leuven (BE); Wim Dekocker, Leuven (BE)

( * ) Notice: Subject to any disclaimer, the term of this patent is extended or adjusted under 35 U.S.C. 154(b) by 0 days.

(21) Appl. No.: 17/252,361

(22) PCT Filed: Jun. 17, 2019

(86) PCT No.: PCT/EP2019/065917
§ 371 (c)(1),
(2) Date: Dec. 15, 2020

(87) PCT Pub. No.: WO2019/238978
PCT Pub. Date: Dec. 19, 2019

(65) Prior Publication Data

US 2021/0269215 A1 Sep. 2, 2021

Related U.S. Application Data

(60) Provisional application No. 62/685,769, filed on Jun. 15, 2018.

(30) Foreign Application Priority Data

Jun. 15, 2018 (BE) ..... 2018/5405

(51) Int. Cl.
*B65D 77/00* (2006.01)
*B65D 25/10* (2006.01)
(Continued)

(52) U.S. Cl.
CPC ..... *B65D 77/003* (2013.01); *B65D 25/108* (2013.01); *B65D 25/30* (2013.01); *B65D 71/16* (2013.01); *B65D 81/3823* (2013.01)

(58) Field of Classification Search
CPC .... B65D 77/003; B65D 25/108; B65D 25/30; B65D 71/16; B65D 71/38; B65D 81/3823; B65D 5/321; B65D 5/323
(Continued)

(56) References Cited

U.S. PATENT DOCUMENTS 2,828,009 A * 3/1958 Noble ..... B65D 71/38 206/427
3,066,795 A 12/1962 Mansfield
(Continued)

FOREIGN PATENT DOCUMENTS

AU 716629 B3 3/2000
CN 101400580 A 4/2009
(Continued)

OTHER PUBLICATIONS

WIPO, ISR for International Application No. PCT/EP2019/065917, dated Jul. 18, 2019.
(Continued)

*Primary Examiner* — Andrew D Perreault
(74) *Attorney, Agent, or Firm* — Hodgson Russ LLP

(57) ABSTRACT

The present disclosure provides a portable cooling multipack for holding and cooling a plurality of beverage containers. The multipack includes a primary container formed from an open top housing, having a bottom surface, and a plurality of sidewalls connected and extended away from the bottom surface to define an inner surface there-between, accessible through a top open surface. The multipack further includes a closing wrap for closing the top open surface of the housing of the primary container. The closing wrap includes a plurality of panels defining a first end panel connected to a second end panel through a bottom panel at one end and extending towards a top panel at another end. The closing wrap is wrapped around a pair of sidewalls of
(Continued)

the primary containers in a vertical direction such that the top panel of the closing wrap sealingly covers the open top surface of the primary container.

18 Claims, 8 Drawing Sheets

(51) Int. Cl.
*B65D 25/30* (2006.01)
*B65D 71/16* (2006.01)
*B65D 81/38* (2006.01)

(58) Field of Classification Search
USPC ..... 220/434
See application file for complete search history.

(56) References Cited

U.S. PATENT DOCUMENTS 3,540,582 A * 11/1970 Wood ..... B65D 71/34 206/192
3,861,530 A 1/1975 Calvert
3,894,681 A 7/1975 Arneson et al.
3,942,631 A 3/1976 Sutherland et al.
4,471,870 A * 9/1984 Uhlig ..... B65D 71/38 206/427
5,246,113 A * 9/1993 Schuster ..... B65D 71/36 206/430
5,495,727 A 3/1996 Strong et al.
5,555,982 A * 9/1996 Kuhn ..... B65D 5/54 206/746
6,702,115 B1 * 3/2004 Roper ..... B65D 5/5071 206/427
8,100,320 B2 1/2012 Brand
2003/0213263 A1 11/2003 Woog
2013/0098977 A1 4/2013 May
2019/0315564 A1 * 10/2019 Chung ..... B65D 13/04

FOREIGN PATENT DOCUMENTS

FR 2687380 A3 8/1993
GB 2168325 A 6/1986
WO 2005100193 A1 10/2005

OTHER PUBLICATIONS

CNIPA, First Office Action for CN Application No. 201980040297.5, dated Feb. 21, 2022.

* cited by examiner

METHOD 600

PORTABLE COOLING MULTIPACK

TECHNICAL FIELD

The present disclosure generally relates to a wrap for closing the top open housing of a primary container of a multipack, and further to a multipack for beverage containers comprising such wrap. More particularly it relates to a portable cooling multipack for cooling the beverage containers contained therein.

BACKGROUND

Containers enclosing liquid foods such as for example, water, beer, beverages, etc. have lately been proved invaluable in a wide array of situations. For example, water containers have widely been used across the globe by the people during travel. Also, campers, hikers and backpackers use portable beverage containers for excursions in remote areas. These containers range from small sized portable containers to large size barrel shaped containers, depending upon the quantity of the beverage enclosed therein.

Most of the beverages such as juices, beer, wines and others are preferably consumed when cold, ideally around 45° F. for juices, and between 50° F. to 60° F. for wines. Therefore, in order to accommodate the various outdoor activities enjoyed by people today, it has long been known to utilize various portable ice receptacles to keep food and drinks cool while away from sources of power and refrigeration.

To avoid the problem of breakage/damage of containers/bottles while transportation and to further enable a proper handling, there has been a many-fold increase in the trend of grouping large number of beverage containers together in the form of multipacks. Most of these include multipack cartons are made of paperboard and/or cardboard material. Further, there has further been many developments for keeping the containers stored within these multipacks in a ready to drink state, many multipack containers were designed to accept ice or other cooling means in order to chill containers in the package without having to use a separate cooling source.

For example, U.S. Pat. No. 5,495,727. discloses an expandable package adapted to accommodate ice for facilitating chilling of the beverage containers stored within. Further, the package includes one or more drain holes for enabling a drainage of fluids formed due to melting of ice and due to any leakage from the beverage containers during shipment and handling. Additionally, the package includes a waterproof lining to prevent or substantially reduce leakage of liquids from within the package.

U.S. Pat. No. 8,100,320, discloses a cooler carton for items such as beverage containers. The carton is formed by folding a carton blank in an erected configuration. The erected carton includes an inner space for holding beverage containers and a containment skirt that extends above the level of the containers stored within the carton. Ice can then be added atop the items to cool their contents and the ice is contained by the skirt. Gussets are formed at lower corner portions of the carton and, along with a moisture barrier, prevent accumulated water from leaking from the bottom region of the carton.

However, various above mentioned multipack coolers, including others currently known carton-based multipacks have certain disadvantages which are common to the prior art in general. One prominent disadvantage in many of the prior art inventions is that the cartons or packages are structurally complex, and are, therefore, expensive to manufacture. Additionally, although many prior art devices are structurally complex, they are not configured in a reinforced manner to hold ice or water for long periods of time. Another disadvantage of many of the prior art devices is that cooled water from melted ice is allowed to drain away from the package, which minimizes the cooling effect of melted ice.

To overcome above problems, there were formed several other multipack cooling containers which included various kind of ice chests. For example, one commonly used ice chest included a double walled metal container with the space between the walls filled with some type of insulation. Such ice chests were prevalent throughout the early part of the century and were used to a fair extent. However, these ice chest, or ice boxes as they were known, while presenting problems of both weight and bulkiness, were not configured to properly hold a group of containers together but randomly contained within the box and therefore had to be taken out individually. Additionally, these individually stored containers and/or bottles, were more prone to damage/breakage during the transportation and therefore were not preferred. To overcome this, a various kind of separator trays were designed to keep the beverage containers separated from each other, but still the problem of weight, bulkiness and the like were not resolved.

Accordingly, as can be seen from the foregoing discussion, there still exists a need for an improved multipack for beverage containers/bottles which while being able to light weight and easy to handle, is strong, cost effective, and is well suitable to be used for carrying the beverage containers while cooling them.

SUMMARY

In an aspect of the invention, a closing wrap for closing the top open surface of the housing of a primary container of a multipack is provided, as well as a multipack for holding a plurality of beverage containers comprising such closing wrap. In particular, the multipack may be a portable cooling multipack. The multipack includes a primary container formed from an open top housing, having a bottom surface, and a plurality of sidewalls connected and extended away from the bottom surface to define an inner surface there between, accessible through a top open surface. The multipack further includes a closing wrap for closing the top open surface of the housing of the primary container. The closing wrap includes a plurality of panels defining a first end panel connected to a second end panel through a bottom panel at one end in a first direction and extending towards a top panel at another end in a second direction opposite to the first direction. In use, the closing wrap is wrapped around a pair of sidewalls of the primary containers in a vertical direction such that the top panel of the closing wrap sealingly covers the open top surface of the primary container.

A benefit of a wrap sealingly closing the open top surface of the primary container is that, when a user lifts the handle, or tries to move the multi pack in a way that the open top housing would typically compress and deform, the top panel acts as the sixth primary container wall, giving the structure much more strength that a typical open five-sided container with a wrap.

This wrap and using in this wrap in a multipack for beverage containers allows to use lightweight materials and to reduce raw material cost combined with automation cost reduction.

Preferably, the beverage container is a bottle shaped container having a bottom surface extended towards a neck portion through a shoulder portion.

Alternatively, the beverage container is a can shaped container having a cylindrical body extended between a top surface and a bottom surface.

Possibly, the primary container may be made in the form of any suitable geometric shape selected from but not limited to a cuboidal, cubical, circular, hexagonal, and the like.

Further possible, each of the plurality of sidewalls of the housing has a height substantially greater than the height of the beverage containers to be stored there within.

Potentially, the first end panel of the closing wrap is adapted to cover a first sidewall of the housing and extended in towards the second end panel adapted to cover a second sidewall opposite to the first sidewall, through the bottom panel adapted to cover the bottom surface of the housing. Further, the first end panel is extended in the second direction towards the top panel adapted to cover the open top surface of the housing of the primary container.

Further potentially, each of the panels of the closing wrap is shaped and dimensioned according to the shape and dimension of a corresponding surface of the housing of the primary container.

Yet further potentially, the second end panel further comprising a closing flap adapted to be complementary engaged with the top panel thereby locking the closing wrap onto the primary container.

Yet furthermore potentially, the closing flap is engaged with the top panel using an engagement mechanism selected from one or more of but not limited to glue-based affixation, notch-based engagement, adhesive strips, and the like.

Additionally, one or panels of the plurality of panels, and preferable the bottom panel of the closing wrap may include an adhesive patch adapted to adhere it onto the bottom surface of the housing of the primary container.

Optionally, the closing wrap includes a handle affixed/glued onto an outer surface of the top panel for facilitating gripping of multipack.

Further optionally, the handle includes an expandable gripping portion extending out of a pocket handle at each of its end such that when a user lifts the multipack the gripping portion stretches out and retracts back once released by the user.

Preferably, the top panel of the closing wrap is a multi-layer structure having a top layer and a bottom layer, the bottom layer adapted to be faced towards the interior of the housing.

Further preferably, the bottom layer of the top panel includes a plurality of holes for supporting each of the beverage container at its neck portion.

Alternatively, the top panel of the closing wrap is a single layer structure.

Further alternatively, the top panel of the closing wrap includes an insert adapted to be glued onto the inner surface thereof. This insert contributes to the strength of the structure by even more acting as a rigid sixth primary container wall and avoiding that the open top housing would typically compress and deform.

Optionally, the insert is a fluted/corrugated cushioning pad having a plurality of holes for supporting each of the beverage container at its neck portion.

Alternatively, the insert is a cushioning pad with no holes and adapted to stabilize the beverage containers from the top.

Generally, the closing wrap is made of a foldable carton blank formed of a material selected from one or more of but not limited to all kind of papers, fiberboard, paperboard, any hybrid material and the like.

Alternatively, the closing wrap may be made of a light-weight plastic material.

Potentially, the primary container may be made of a material selected from one of but not limited to an integrated molded plastic, a metal tin, a paper thermoform, and the like.

Further potentially, the primary container includes a layer of a heat-insulating material configured onto the inner sidewalls of the housing.

Possibly, the primary container comprising a plurality of spaced apart depressions configured onto the inner bottom surface of the housing.

Further possibly, each of the plurality of spaced apart depression has a depth ranging between 5 mm and 30 mm and preferably between 10 mm and 20 mm.

Yet further possibly, each of the plurality of spaced apart depression has a shape and dimension complementary to a bottom surface of the beverage container so as to facilitate retaining a beverage container thereupon.

Optionally, the primary container includes one or more handle openings/elongated slots configured on a pair of opposite sidewalls thereof.

Further optionally, the handle opening is shaped to facilitate gripping of the container by user hands.

Possibly, the primary container includes one or more, optionally corrugated, spacer tray, each having a plurality of cutouts for horizontally supporting the plurality of the beverage containers together within the housing.

Further possibly, the one or more, optionally corrugated, spacer trays are arranged in a vertically spaced apart manner wherein further each of the (optionally corrugated) spacer tray is of a dimension same as the inner dimension at a point of contact with the housing. Note that in the above embodiment, one or more crosslinks may or may not be provided coupling the separate spacer trays while fixing the vertical separation thereof. The crosslinks can be provided in many forms, for instance as strips (of varying width, ranging from several mm to several cm, up to a majority of the length or width of the spacer trays themselves) or bars/pillars of material (cardboard, paper, thermoform, metal, plastic, etc.) connecting two layers of spacer trays at one or more positions (preferably symmetrically divided). In some embodiments, the crosslinks will substantially comprise the same material as the spacer tray, in others this will be different, depending on the needs and circumstances (for instance stronger crosslinks, crosslinks more resistant to humidity, heat, etc.). In certain embodiments, the separate spacer trays may comprise or consist of different materials, again depending on circumstances.

Yet further possibly, each of the plurality of cutouts have a diameter equal to a diameter at a position of the beverage container at a height corresponding to the point of contact between the spacer tray and the housing.

The closing wrap may further include an additional flap extending away from the closing flap and being adapted to be folded inwardly into the primary container housing, said additional flap putting pressure on the spacer tray to avoid that it moves upwardly in case the multipack is shaken during carrying or transportation. Said additional flap may be further adapted to interact with the spacer tray, for instance by providing protrusions that are positioned to correspond to the positioning of cutouts. As such, the protrusions may be partly introduced into the cutouts, further securing the wrap and spacer trays in their respective positions.

In a preferred embodiment, the packaging comprises a two-level spacer tray, which levels are vertically interconnected via a number of crosslinks, preferably the levels separated over a vertical distance of at least 2 cm, preferably at least 4 cm. We note that this embodiment is especially advantageous for multipacks for holding bottles. The specific shape of a bottle, and the variation in diameter between neck and body, allows the spacer tray to dimension its apertures through which the bottles fit, so that the lower aperture (that of the lower layer) allows the insertion of (at least part of) a body of a bottle, while the upper aperture (of the upper layer) is dimensioned to allow insertion of (part of) the neck section of said bottle while not allowing insertion of the body. This ensures that the spacer is delimited in its vertical movement downwardly, and remains suspended above the bottom of the primary container, thereby providing a double horizontal fixation of the held bottles (at body and at neck level). Particularly preferable, the wrap is adapted to have the additional flap as mentioned above, which can interact with the spacer tray and delimit its vertical movement in the upwards direction. As such, the bottles are entirely fixed.

Note that the above may or may not be combined with a dimensioning of the overall length and width of the spacer tray to 'fit' inside of a primary container with a decreasing size along its depth dimension (being smaller towards the bottom).

In another aspect of the invention, a method for assembling the multipack is disclosed. The method includes receiving one or more beverage containers within the primary container such that each of the beverage container is placed onto one of the plurality of spaced apart depressions configured on the bottom surface of the housing. The method further includes vertically wrapping the closing wrap around a pair of opposite sidewalls of the primary container by folding the foldable blank. such that the top panel of the closing wrap covers the open surface of the housing. The method further includes locking the closing wrap by engaging the top panel with the closing flap of the second end panel.

The method further includes attaching a handle onto the top panel of the closing wrap.

Optionally, the method includes gluing the bottom panel onto the bottom surface of the primary container.

Further optionally, the method includes gluing the insert on the inside of the top panel before closing the top panel.

In the case that the multipack is a cooling multipack, the method may include placing one or more cooling medium such as crushed ice, and the like within the primary container within the space between the plurality of spaced apart dimensions.

It should be noted that the invention expertly aims at separating functionalities of the two distinct parts of the packaging. The primary container being suitable for providing the necessary strength and support in holding the beverage containers therein, and is therefore sufficiently rigid and strong. In this light, the appropriate materials can be chosen, preferably lightweight such as aluminum, and the container itself can be adapted to fit the functionalities it is intended for, while leaving certain other aspects to the second part of the packaging. As such, for instance apertures can be provided at strategic places, which in themselves do not jeopardize structural strength, but can reduce weight (and material costs), allow aeration, allow liquid to drain out of the primary container, etc. Furthermore, decorations can be provided more easily on 'hard' support surfaces. A rigid primary container finally allows to stack the primary containers on top of each other without relying on the beverage containers held therein to provide sufficient support, as would be the case in the prior art embodiments. Even in embodiments wherein the base of the primary container is smaller than the open top, (and a higher placed primary container would then rest on beverage containers of the underlying primary container), this can be easily avoided by providing support plates between layers of primary containers, ensuring that the weight rests on the primary containers, whereas in such prior art as U.S. Pat. No. 3,066,795 this still would rest on the beverage containers.

Accordingly, the second part of the packaging, the (foldable) wrap does not substantially contribute to the structural strength (aside from linking the tops of at least two opposite side walls, thereby avoiding compression or deformation). Therefore, other aspects can be considered when choosing material(s) and characteristics such as thickness, elasticity, resistance and the likes. It is for this matter that in a preferred embodiment, the wrap material at least comprises flexible material, such as cardboard, paper and/or plastic materials. The functionality of this wrap layer lies, amongst others, in covering the insides of the primary container, and sealingly closing it, thereby protecting the beverage containers within from outside influences (dirt, dust, water, etc.).

The applicant thus proposes a preferred embodiment, wherein the primary container is substantially rigid (i.e. at least the bottom and at least two oppositely positioned sidewalls, preferably all of the side walls). Under 'rigid', it is to be understood that the primary container sidewalls are suitable for supporting at least the weight of one other multipack according to the invention, filled with (full) beverage containers. Preferably, the primary container is suitable for supporting several times this weight, which can be accomplished by material choice and/or variation in material characteristics (thickness, form, etc.).

In a preferred embodiment, the wrap is substantially thinner than the walls of the primary container.

In a preferred embodiment, the wrap is waterproof, in the sense that it does not absorb or allow transit of water through it.

The details of one or more implementations are set forth in the accompanying drawings and the description below. Other aspects, features and advantages of the subject matter disclosed herein will be apparent from the description, the drawings, and the claims.

DETAILED DESCRIPTION

As required, a schematic, exemplary-only embodiment of the present application is disclosed herein; however, it is to be understood that the disclosed embodiment is merely exemplary of the present disclosure, which may be embodied in various and/or alternative forms. Specific structural and functional details disclosed herein are not to be interpreted as limiting, but merely as a basis for the claims and as a representative basis for teaching one skilled in the art to variously employ the present disclosure in virtually any appropriately detailed structure.

Aspects, advantages and/or other features of the exemplary embodiment of the disclosure will become apparent in view of the following detailed description, which discloses various non-limiting embodiments of the invention. In describing exemplary embodiments, specific terminology is employed for the sake of clarity. However, the embodiments are not intended to be limited to this specific terminology. It is to be understood that each specific portion includes all technical equivalents that operate in a similar manner to accomplish a similar purpose.

Exemplary embodiments may be adapted for many different purposes and are not intended to be limited to the specific exemplary purposes set forth herein. Those skilled in the art would be able to adapt the exemplary-only embodiment of the present disclosure, depending for example, on the intended use of adapted embodiment. Moreover, examples and limitations related therewith brought herein below are intended to be illustrative and not exclusive. Other limitations of the related art will become apparent to those of skill in the art upon a reading of the following specification and a study of the related figures.

The present application discloses a cooling multipack formed of a primary bucket and a closing wrap, for use in holding a plurality of beverage containers enclosing liquids such as cold drinks, beer, wines, mineral water etc. in a top upright position. The multipack while being portable, is able to cool the beverage containers stored there within. While the beverage containers suited for the current disclosure is a generally bottle shaped container having a bottom surface extended towards a neck portion through a shoulder portion, it should be understood that the embodiments of the present invention may be applied in combination with various type of containers irrespective of size, shape and materials, used in the beverage industry. It must also be noted that, as used in this specification and the appended claims, the singular forms "a," "an" and "the" include plural referents unless the context clearly dictates otherwise. Thus, for example, the term "an opening" is intended to mean a single opening or a combination of openings, "a sidewall" is intended to mean one or more sidewalls, or a combination thereof.

Figure 1:
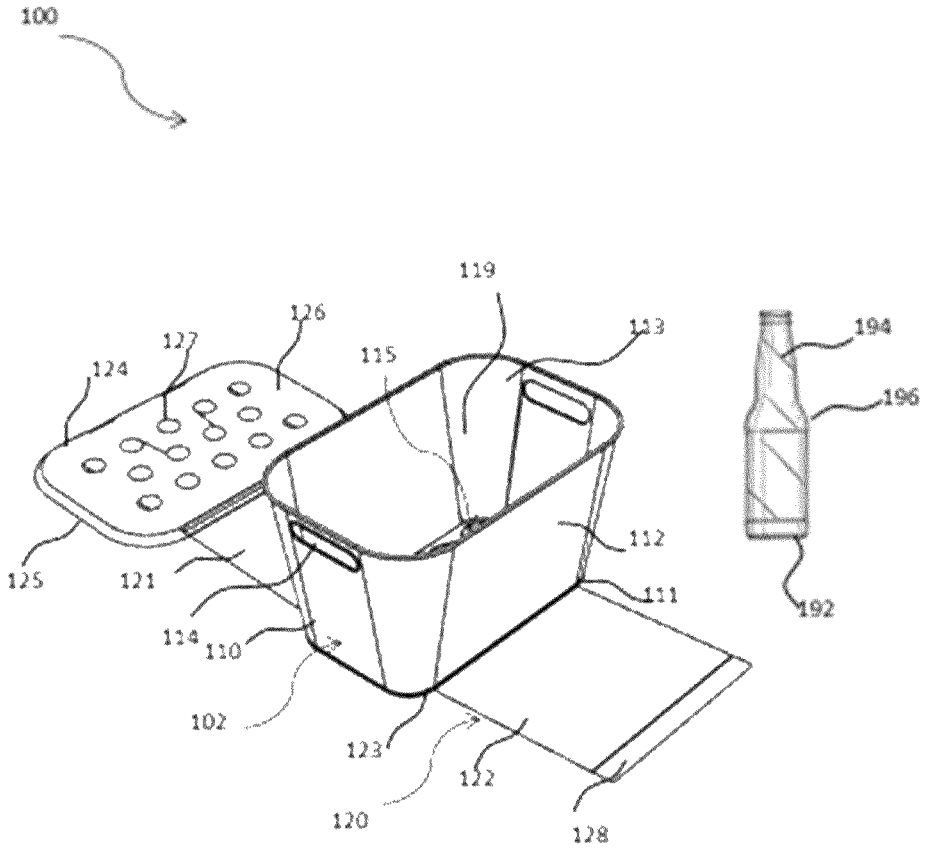
FIG. 1 illustrates a schematic diagram representing a cooling multipack, in accordance with a preferred embodiment of the present disclosure.
Figure 2:
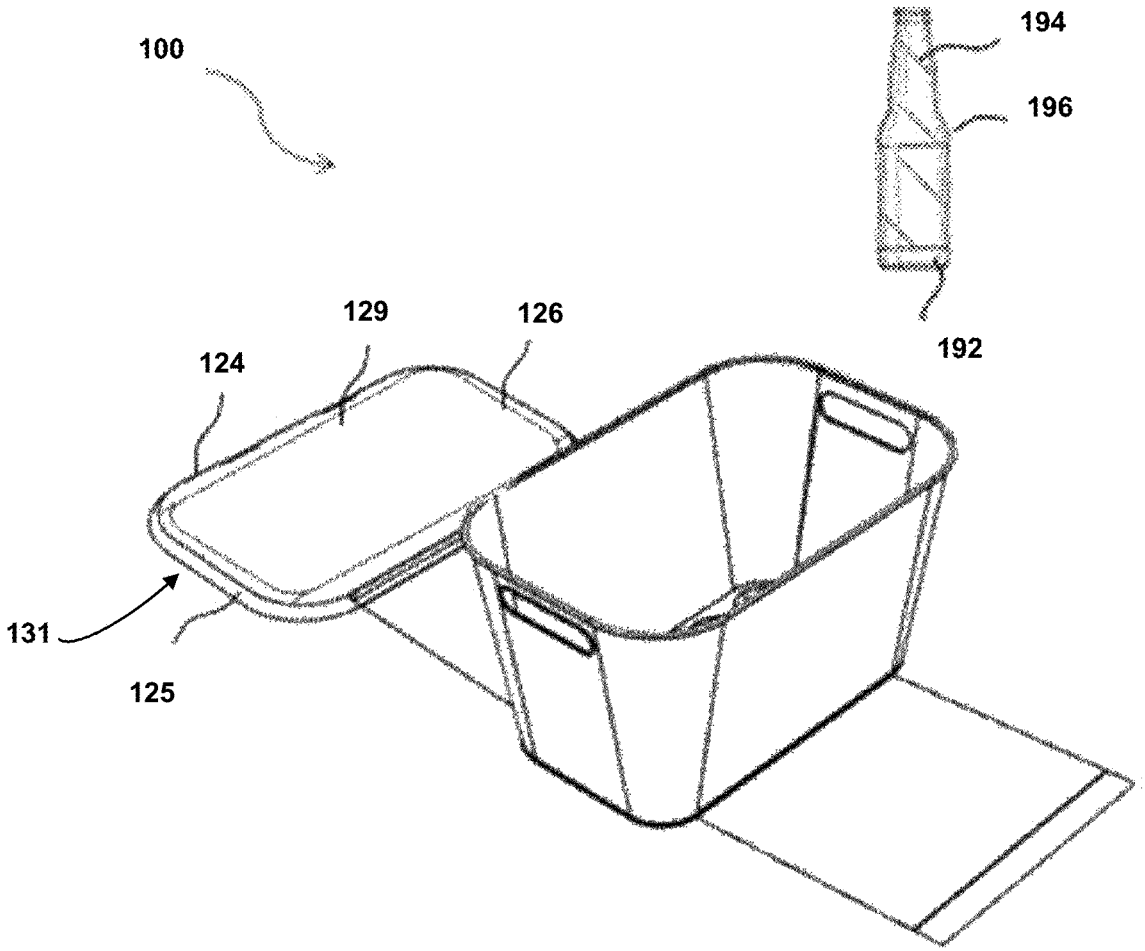
FIG. 2 illustrates a schematic diagram representing a cooling multipack, in accordance with another embodiment of the present disclosure.

In description of the FIGS. 1-2 that follow, elements common to the schematic system will have the same number designation unless otherwise noted. In a first embodiment, as illustrated in FIG. 1, the present disclosure provides a provides a multipack 100 for holding a plurality of beverage containers 190. The beverage container 190 is a generally bottle shaped container having a bottom surface 192 extended towards a neck portion 194 through a shoulder portion 196. The multipack 100 comprises primary container 102 formed of an open housing 110. The housing 110 includes a bottom surface 111, and a plurality of sidewalls 112 connected to the bottom surface 111 and extended towards an open top surface 113, defining an inner surface 119 there between. The housing 110 further includes one or more handle openings 114 configured within at least one of a pair of opposite sidewalls of the plurality of the sidewalls 112. The housing 110 further includes a plurality of spaced apart depressions 115 onto the bottom surface 111 defining a surface for retaining the plurality of beverage containers 190 in a spaced apart manner. Accordingly, the depressions 115 are shaped according to a shape of the bottom surface 192 of the beverage container 190.

The multipack 100 further includes a closing wrap 120 adapted to be wrapped around the primary container 102. The closing wrap 120 includes a first end panel 121 connected to a second end panel 122 through a bottom panel 123 at one end and extending towards a top panel 124 at another end. The top panel 124 is a generally multilayer structure having top layer 125 and a bottom layer 126 such that the bottom layer 126 is faced towards the inner surface 119 of the housing 110. The bottom layer 126 includes a plurality of holes 127 adapted to be engaged with the neck portion 194 of the beverage container 190. The closing wrap 120 further includes a closing flap 128 extended away from the second end panel 122 adapted to be locked onto the top panel 125 through one or more engagement means [not shown].

In use, the plurality of the beverage containers 190 is placed within the primary container 102 such that each of the beverage container 190 is placed onto a separate depression 115. Further, one or more cooling medium such as ice cubes, crushed ice, and the like is placed within the primary container 102. Thereafter, the closing wrap 120 is wrapped vertically around a pair of opposite side walls of the plurality of sidewalls 112 such that when wrapped, the top panel 124 of the closing wrap 120 sealingly covers the top open surface 113 of the housing 110 and the each of the plurality of holes 127 engages and secures with the neck portion 194 of each of the beverage containers 190. Thereafter, the closing flap 128 is engaged with the top panel 124 thereby locking the closing wrap 120 onto the primary container 102

The multipack 100 further includes a handle 131 attached on to the top layer 125 using one or more fixation mechanisms (not shown). In one preferred embodiment, the handle is configured to be affixed/glued/configured onto the top layer 125 of the top panel 124 through a handle opening therein, such that a gripping portion of the handle is visibly accessible from the handle opening and may be stretched out therefrom.

In a modification of the first embodiment, as illustrated in FIG. 2, the top panel 124 is a single layer structure. Further in such embodiments, the multipack 100 includes an insert body 129 adapted to be attached onto an inner surface of the top panel 124. The insert 129 may be a cushion body adapted to cushion the beverage containers stored within the primary container 102. Further, optionally, the insert body 129 may include a plurality of holes [not shown] similar to the plurality of holes 127 and adapted to adapted to be engaged with the neck portion 194 of the beverage container 190.

FIGS. 1 and 2 schematically show the arrangement of the basic components of the multipack 100 of the present disclosure. However, in the construction of commercial functional units, secondary components such as couplers, connectors, support structure and other functional components known to one of skill in the field of multipacks and more particularly the multipack for beverage container technology, may be incorporated within the multipack 100. Such commercial arrangements are included in the present invention as long as the structural components and arrangements disclosed herein are present. Accordingly, it is to be contemplated that the multipack 100 may be configured to be used for any kind of beverage and/or liquid and/or food containers and may be incorporated in any possible shape as deems possible without deviating from the scope of the current invention.

Referring to FIG. 2, a primary container, generally represented by a numeral 200 is illustrated in accordance with an embodiment of the present disclosure. The primary container 200 includes a housing 210 for holding a plurality of generally bottle shaped beverage containers 290. While the shape of the beverage container 290 is bottle shaped for exemplary purpose only, it should be understood that the beverage can 290 may be of any shape and size, including the radius and height suitable for enclosing its contents. Further, while the illustrated drawings display the containers 290 in the form of the bottles, but other types of containers (e.g., cans) can be stored within the primary container 200 of the current disclosure.

Further, the shape and size, including the height of the primary container 200 and the housing 210 may be varied depending on the design constraints and requirements for its application. For example, within the illustrated embodiment, the primary container 200 is sized to house fourteen containers in a displayed arrangement, but it is understood that the carton may be sized and shaped to hold containers of a different or same quantity and/or in different row/column arrangements (e.g., 1×6, 3×6, 2×6, 4×6, 2×3×4, 2×6×2, 2×9, 3×5, 3×5×2, etc.).

Figure 3:
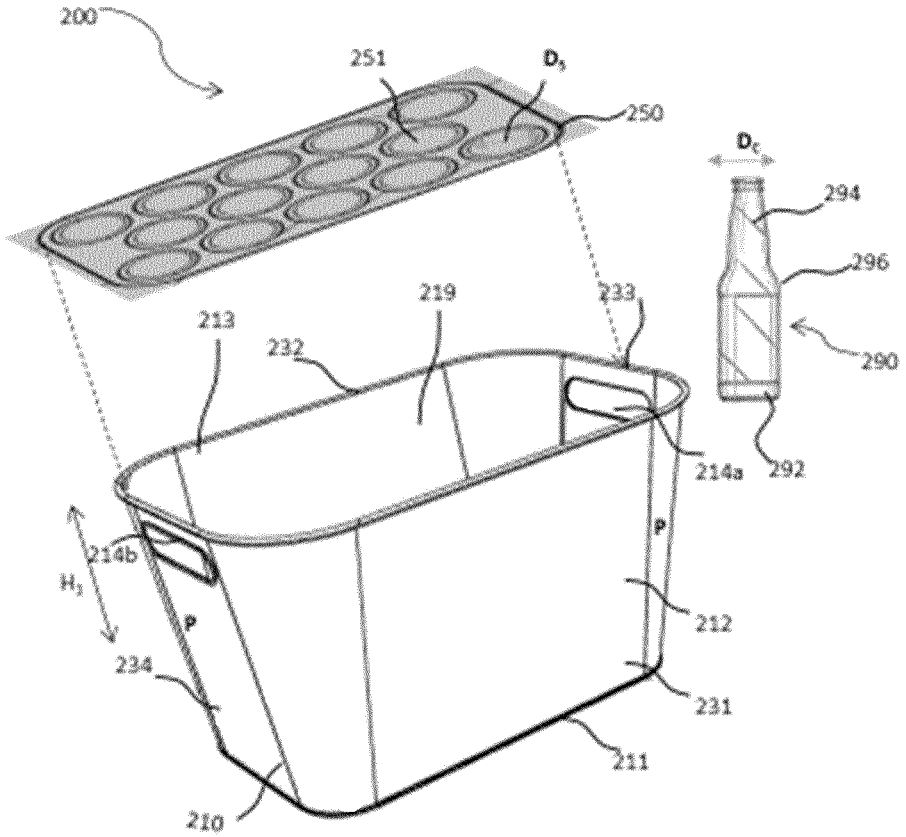
FIG. 3 illustrates a perspective view of a primary bucket of the multipack, in accordance with the preferred embodiment of the present disclosure.
Figure 4:
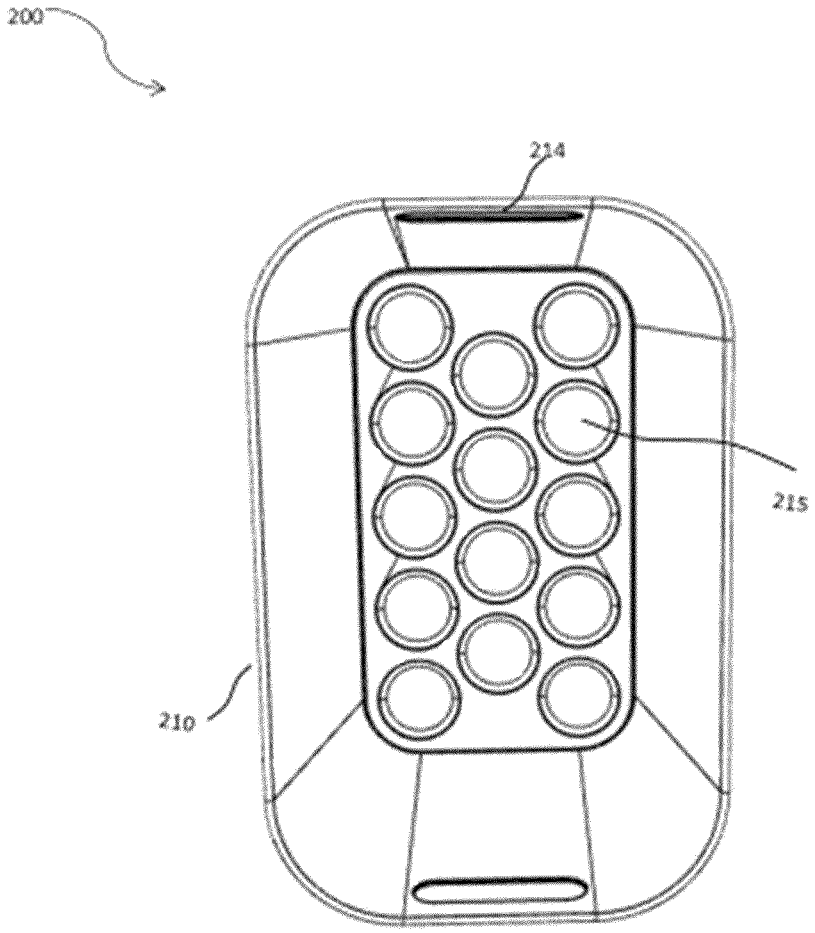
FIG. 4 illustrates a top view of a primary bucket of the multipack, in accordance with the preferred embodiment of the present disclosure.

The primary container 200, as illustrated in FIGS. 3 and 4, includes an exemplary cuboidal shaped open top housing 210 in accordance with a preferred embodiment of the current disclosure and includes a receiving portion 219 for vertically receiving the plurality of beverage containers 290. The receiving portion 219 includes an inner space defined by a bottom surface 211 connected to a plurality of upstanding sidewalls 212 including a first sidewall 231, a second sidewall 232, a first end wall 233 and a second end wall 234 and extended towards an open top surface 213. The housing 210 further includes a plurality of spaced apart depressions 215 [illustrated in FIG. 4], configured within the receiving portion 219, each of the depression 215 defining a surface for retaining one of the plurality of beverage containers 290 in a spaced apart manner. Accordingly, the depressions 215 are shaped and dimensioned complementarily to a shape of the bottom surface 192 of the beverage container 190. Further, each of the plurality of the spaced apart depressions 215 has a depth ranging between 5 mm and 30 mm and preferably between 10 mm and 20 mm to facilitate a proper holding of a bottom surface 292 of the beverage container 290.

The primary container 200 further includes one or more spacer trays 250, each having a plurality of cutouts 251 generally equal to number of containers to be held within the housing 210 and aligned in accordance with the spaced apart depressions 215 such that each of the cutouts 251 is able to horizontally support one the plurality of the beverage containers 290. Further, the one or more (optionally corrugated) spacer trays 250 are arranged in a vertically spaced apart manner such that each of the (optionally corrugated) spacer tray 250 is of a dimension same as the inner dimension at a point of contact P with the housing 210. Further, an inner diameter $D_s$ of each of the cutouts is equal to a diameter $D_c$ at a position of the beverage container 290 at a height corresponding to the point of contact P between the spacer tray 250 and the housing 210. In a preferred embodiment, the primary container 200 includes two spaced apart spacer trays 250 for horizontally supporting each of the beverage containers 290.

The primary container 200 further includes one or more handle openings 214 configured onto at least one or more of, and preferably on a pair of opposite sidewalls 212. For example, as illustrated in FIG. 3, the housing 210 includes a first handle opening **214*a* on the first end wall 233 and a second handle opening 214*b* on the second end wall 234. In a preferred embodiment, the handle opening 214 is generally an elongated slot for facilitating holding and/or gripping of the housing 210. However, in other embodiments of the present invention, the handle opening 214 may be shaped into any desired shape suitable to provide an easy handling/gripping of the housing 210**.

The primary container 200 including the housing 210 and spacer trays 251 may be made of a material selected from one of but not limited to an integrated molded plastic, a metal tin, a paper thermoform, and the like.

In a preferred embodiment, the primary container 200 including the housing 210 is integrally molded and made of a light weight plastic material selected from one or more of but not limited to plastic material such as group of thermoplastics including acetal, acrylic, cellulose acetate, polyethylene, polystyrene, vinyl, and nylon. In such instances, the spaced apart depressions 215 may be best suitable to hold the beverage containers there within and generally has a depth ranging between 20 mm and 30 mm. Such molded plastic material has an additional advantage that it does not damage the beverage containers 290 stored there within due to its soft and smoothly finished surface.

In another embodiment of the present disclosure, the primary container 200 including the housing 210 is made of a suitable metal such as a Tin, and generally having a construction similar to a trash can, cookie tin, and the like, already known in the art. In such instances, the spaced apart depressions 215 has a depth generally ranging between 5 mm and 15 mm.

In yet another embodiment, the primary container 200 including the housing 210 is made of a paper thermoform material and having a construction similar to thermoform boxes, already known in the art. In such instances, the spaced apart depressions 215 has a depth generally ranging between 15 mm and 25 mm.

In all such embodiments, the housing 210 may further include a coating/layer of a heat insulating material adapted to avoid a transfer of heat from outside towards the inner surface of the housing 210. The insulating material may be selected as one or more of but not limited to various kind of plastics, rubbers, insulating paints, compositions, and the like.

Figure 5A:
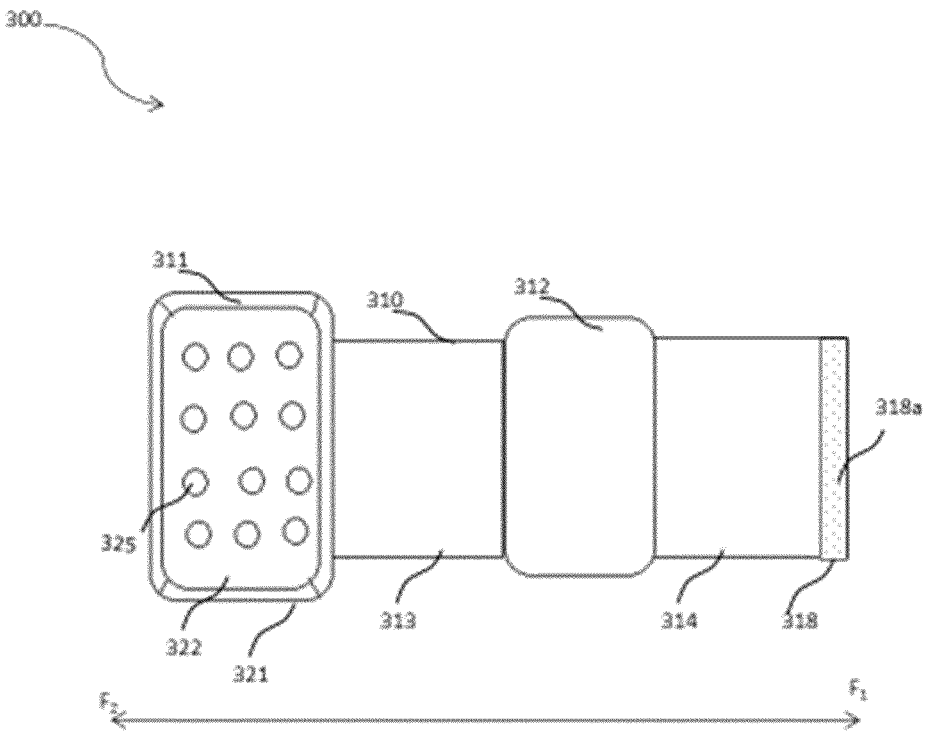
FIG. 5*a* illustrates a schematic diagram representing a representing a closing wrap of a cooling multipack, in accordance with the preferred embodiment of the present disclosure.
Figure 5B:
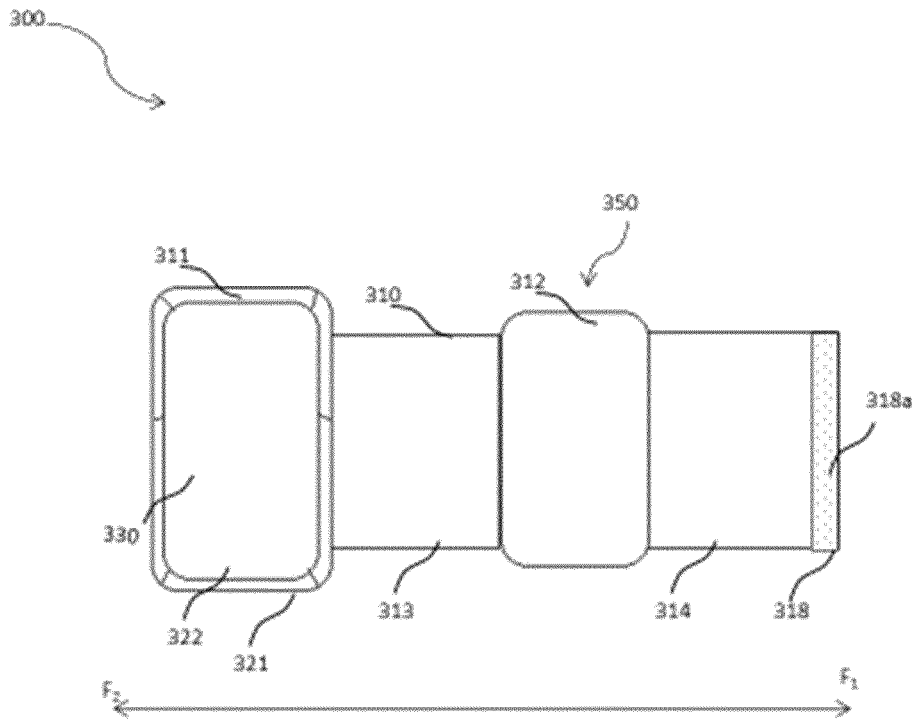
FIG. 5*b* illustrates a schematic diagram representing a representing a closing wrap of a cooling multipack, in accordance with the second embodiment of the present disclosure.
Figure 5C:
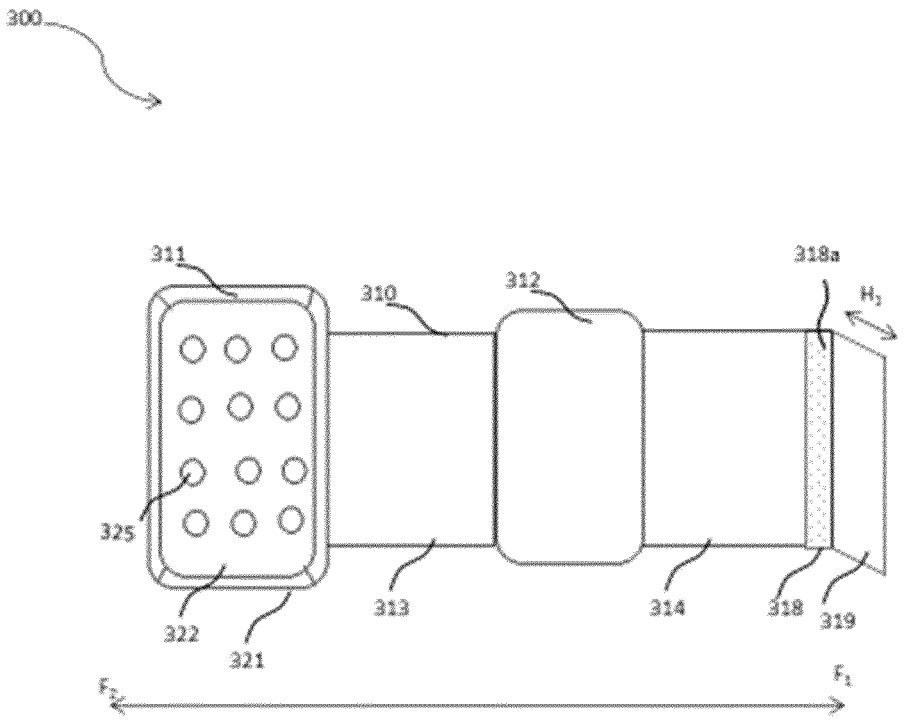

Referring to FIGS. **5*a* and 5*b*, a closing wrap, generally represented by a numeral 300 is illustrated in accordance with an embodiment of the present disclosure. The closing wrap 300 includes a folded blank 350 comprising a plurality of wall panels 310 including a top wall panel 311, a bottom wall panel 312, a first sidewall panel 313, and a second sidewall panel 314. Specifically, the first sidewall panel 313 is extended towards a second sidewall panel 314 through a bottom wall panel 312 in a first direction $F_1$. Further, the first wall panel 313 is extended towards the top wall panel 311 in a second direction $F_2$. Each of the plurality of wall panels 310 include a foldable line [not shown] defining the folding position of the panels which when folded forms the wrap in an erected position to be disposed over a corresponding sidewall of the primary container 200. Accordingly, the shape, size and dimensions of each of the panel 310 of the closing wrap is varied in accordance to the dimensions, shape and size of the corresponding sidewalls 210 of the primary container 200. The foldable blank 350 further includes a closing flap 318 extended away from the second wall panel 314 adapted to be locked onto the top panel 311 through one or more engagement means 318***a*. In a preferred embodiment, the engagement means 318*a* may be an adhesive patch/strip configured onto the closing flap 318. Further in such embodiments, the adhesive patch/strip 318*a* may be configured such that its adhesive surface is directed in an upward direction of the closing flap 318. Accordingly, in such embodiments, the closing wrap 300 is closed by first folding down the closing flap 318 followed by closing of the top panel 311 thereby gluing the top panel 311 onto the closing flap 318 thereby locking the closing wrap 300 onto the housing 210. The dimensions of the closing flap 318 in such embodiment is generally same as the dimension of the top open surface 213 of the housing 210. Furthermore, in such embodiments, in some instances, the closing wrap 300 may further include an additional flap 319 (as illustrated in FIG. 5*c*) extending away from the closing flap 318. Such an additional flap 319 is adapted to be folded inwardly into the primary container housing 310 thereby closing the wrap onto the housing 310. Preferably, the additional flap 319 is of a height h1 equaling the distance between the top surface 213 of the housing 210 and the point of contact P with the spacer tray 250 such that when folded into the housing 310, the additional flap 319 applies a downward pressure onto the spacer tray 250 thereby keeping it in place and avoiding any accidental upward movement of the package 200 during transportation thereof.

In an embodiment, one or more panels 310 may include adhesive strips and/or any kind of adhesive surface to facilitate gluing of the one or more panel 310 onto a corresponding surface of the primary container 200. Preferably, the adhesive strip/adhesive surface is configured onto the bottom panel 312 adapted to be glued onto the bottom surface 211 of the housing 210 of primary container 200.

The top panel wall 311 of the closing wrap 300 is generally a multilayer structure including a top layer 321 and a bottom layer 322 generally connected and extended away from the top layer 321. Preferably, the bottom layer 322 is spaced apart from the 321 and includes a plurality of holes 325 configured thereon and adapted to be engaged with the neck portion 294 of the beverage container 290. The number of plurality of holes 325 is generally equal to the number of beverage containers 290 adapted to be stored within the primary container 200. Further, this plurality of spaced apart holes 325 are arranged such that when the top panel 311 is closed, each of the plurality of holes 325 is adapted to engaged with one of the beverage containers 290 at its neck portion 294. In some embodiments, the plurality of holes 325 are deep in configuration and therefore secure the beverage containers 290 by engaging only a large part of the neck portion 294 thereof. However, in some other embodiment, the plurality of holes 325 are of shallow configuration such that they secure the beverage containers 290 by engaging only a small part of the neck portion 294 thereof. Further in some other embodiments, the bottom layer 322 does not include any holes 325 there within and is provided with a cushioning pad [not shown] glued/affixed/configured thereon adapted to secure the beverage containers 290 by compressing from a top direction but without engaging with the neck portion 294 of the beverage containers 290. Such an embodiment is particularly suitable for the instances where the beverage container 290 is a metallic can and/or other kind of containers not having a neck portion on the body thereof.

In some embodiments of the present invention, the top panel wall 311 of the closing wrap 300 is generally a single layer structure. In such embodiments, the closing wrap 300 further includes an insert body 330 adapted to be glued/affixed onto an inner surface of the top panel 311. Such an insert body 330 in some embodiments include a plurality of holes [not shown] similar to the plurality of holes 325 adapted to be engaged with the neck portion 294 of the beverage container 290. In some embodiments, the insert body 330 does not include any holes there within and is adapted to secure the beverage containers 290 by compressing from a top direction but without engaging with the neck portion 294 of the beverage containers 290. Such an embodiment is particularly suitable for the instances where the beverage container 290 is a metallic can and/or other kind of containers not having a neck portion on the body thereof. The insert body 330 is generally made of a cushioning material selected from one or more of but not limited to foam, rubber, paperboard, fiberboard, corrugated board, soft plastic, any known elastic material and the like.

In some other embodiments, the closing wrap may further include a handle [not shown] configured onto the top wall panel 311 thereof for facilitating the handling/gripping of the primary container 200. In an embodiment of the present invention the handle may include a detachable handle affixed onto the top panel of the closing wrap 300. The handle in such embodiments include a gripping portion affixed within a handle pocket at each of its end. The gripping portion is a user graspable portion of the handle.

The gripping portion is configured to be accessible and stretchably extendible out of the handle pockets such that the gripping portion is stretched out when lifted by the user and may move to its original position within the handle is released by the user.

The gripping portion must be of a material strong and elastic enough that when receives a stretching force due to the lifting operation performed by the user, it in turn lifts the primary container 200 and doesn't break away therefrom.

The handle pocket may be affixed onto the top panel 311 using one or more fixation portions. The fixation portion may be any fixation mechanism such as retention tabs, gluing strips, or other mechanical fastener such as rivets, thread, buttons, and the like. Further in other embodiments, any fixation mechanism may be any currently known that may be suitably used without deviating from the scope of the current disclosure.

In another embodiments of the present invention, the handle may be any conventionally known handle suitable for use without deviating from the scope of the current invention.

In use, each of the plurality of the panels 310 is folded along the folding lines and disposed vertically around a pair of opposite sidewalls 311 of the housing 310. In some embodiments, the pair of opposite sidewalls include first sidewall 231 and the second sidewall 232. In other embodiments, the pair of opposite sidewalls include the first end wall 233 and the second end wall 234. In yet other embodiments where the housing is of a shape having more than 4 sidewalls, any pair of opposite sidewalls may be wrapped around with the closing wrap 300 such that the top panel covers the open top surface of the housing 310.

The engagement means for locking the closing flap 318 onto the top panel may any known engagement mechanism such as including but not limited to gluing, notches-based engagement mechanism, adhesive patches, retention tabs, and any other suitably known mechanism for locking the closing flap 318 onto the top panel 311. In preferred embodiments, the top panel 311 may include one or more insertion slots [not shown] configured to receive the closing flap 318 therein to facilitate facilitating a locking of the closing wrap 300.

In the current example, since the shape of the primary container 200 is cuboidal, each of bottom surface 211, the top open surface 213, the plurality of sidewalls 212, has a generally rectangular shape. Accordingly, each of the panels 310 is of a rectangular shape and have a width according to the width of corresponding wall 212 and a length equal to the length of the corresponding wall 212. However, in some embodiments, the width of each of the panel 310 is independent of housing 210 and may be different, and generally lesser then the width of corresponding surface of the primary container 210.

The closing wrap 300, including the plurality of panels 310 and the layers of the top panel 311 may be made of any material selected from but not limited to a cardboard, a paperboard, corrugated board or the like already suitably known in the art. Further in some embodiments, the closing wrap 300 may be made of other suitable light weight material such as plastic, and the like.

Figure 6:
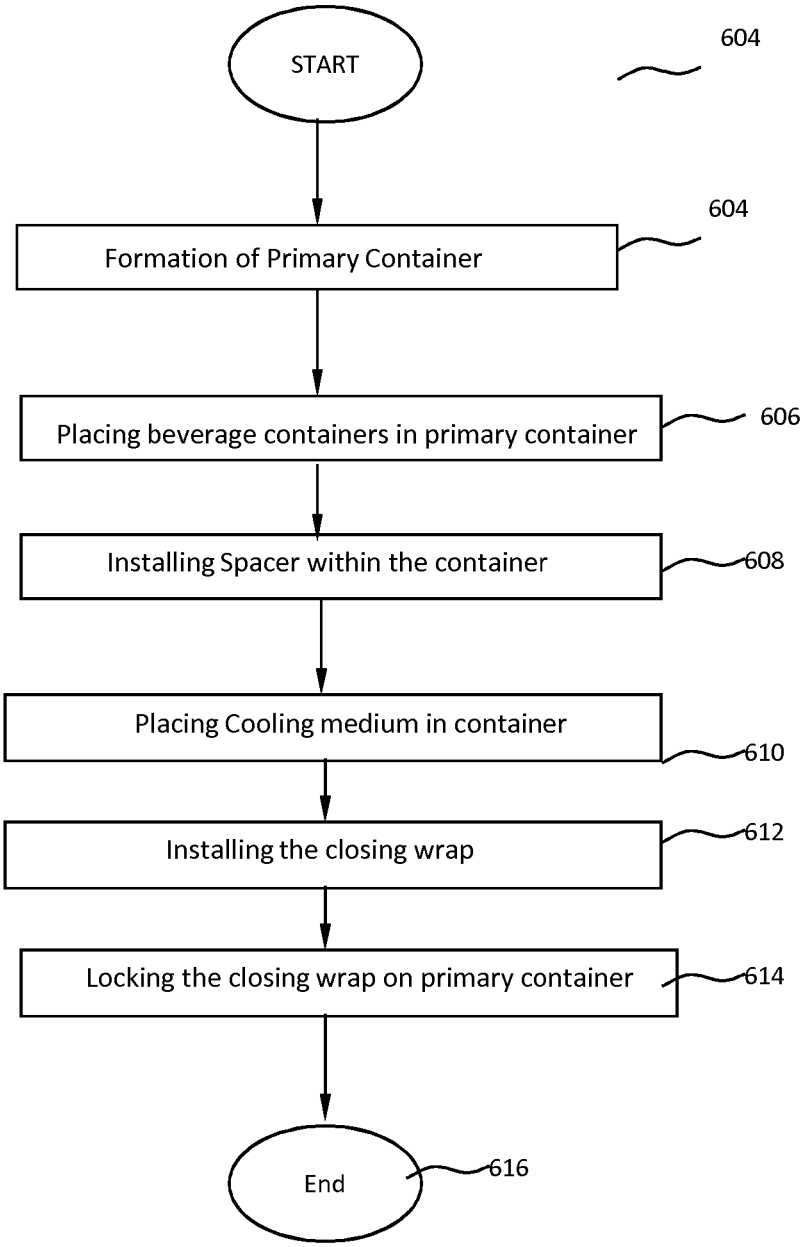
FIG. 6 depicts a flowchart illustrating the steps for assembling a multipack, in accordance with an embodiment of the present disclosure.

FIG. 6 with reference to FIGS. 1 through 5, is a flow diagram illustrating a method 600 of assembling the multipack 100 of the present disclosure. The method starts at step 602 and proceeds to step 604 where the primary container 200 having housing 210 having a plurality of depression is formed from any predetermined method to receive a plurality of predetermined number of beverage containers 290. Thereafter the method proceeds to step 606 where a plurality of beverage containers is placed within the receiving portion 315 of the housing 310 such that each of the depression within the housing 210 receives one of the plurality of beverage containers 190. Once the containers are placed, the method 600 proceeds to step 608 where the one or more (optionally corrugated) spacers are installed within the primary container 200 such that each of the beverage containers is supported at a predetermined portion thereof. Preferably, two (optionally corrugated) spacer trays are installed, with one at the bottom of the housing and other at the neck portion such that any part of (optionally corrugated) spacer tray does not impact the packaging and labels of the beverage containers. Thereafter at step 612, the closing wrap 300 is installed over the housing 310 such that the top panel 311 sealingly covers the top open surface of the housing 310. Further, each of the plurality of holes is engaged with a corresponding beverage container at its neck portion. Thereafter, the method 600 proceeds to step 614, where the closing flap 300 is locked by locking the closing flap 318 onto the top panel 311 using the one or more engagement mechanism 318*a*. Further, in some embodiments, where the engagement mean 318*a* is an upwardly directed adhesive patch, as disclosed earlier, the closing flap 318 is folded down first to cover the top open surface 213 and thereafter the top panel 311 is closed onto the closing flap 318 such that it glues thereupon with the adhesive portion of the adhesive patch 318*a* Optionally, the method 600 may include an additional step 616 of attaching a predetermined handle [not shown] onto one of the top panel 311 of the closing wrap. In some embodiments, the optional step 616 may be performed either before the step 612 or after the step 612. Further, in the case the multipack is a cooling multipack, the method may have a step 610 where any known cooling medium is placed within the spaces between the plurality of beverage containers 290.

INDUSTRIAL APPLICABILITY

The present disclosure relates to a multipack 100 formed of a primary container 200, and having a closing wrap 300, enclosing and securely carrying container containing liquids, such as beer, wine, cider, hard liquor (e.g., distilled beverage, spirit, liquor, hard alcohol, etc.), soft drinks (e.g., cola, soda, pop, tonic, seltzer), iced tea, soda water and other types of carbonated/non-carbonated beverages. The multipack 200 while being cost-efficient and portable, is able to cool the beverage containers stored therein. Further, the multipack of the current disclosure is easy to be assembled by retail consumers, or by the retailers, and offers an easy yet comfortable shipping, handling and transporting of beverage cans of any shape, size or any variety of configurations. While the multipack 100 is described for holding and carrying beverage cans having a generally bottle shape, it is also contemplated for a person skilled in the art that the multipack 200 of the current disclosure may be implemented in various industries such as food industry, transport industry, house hold appliance industry in transportation of any kind of containers of any shape, size or any variety of configurations, without limiting it to the beverage industry.

As should be appreciated, the realization of such a multipack having the primary container 200 and the closing wrap 300, each being formed of a very light weight material allows the end consumer to safely, easily and comfortably pick up and carry the multipacks having a plurality of beverage cans. Further, the multipack of the current disclosure provides suitable means such as plurality of deep holes, cushioning pad, spacer trays, bottom depressions, etc. for facilitating placement, of the beverage containers in a spaced apart manner and further to avoid the movement of the containers during shipping, transportation, and the like. Therefore, any damage to the bottles and labels thereof is avoided. Accordingly, the bottle made of fragile material such as glass may comfortably be carried using the multipack of the current disclosure.

Since the primary bucket is made of a light but heat insulating material, such as thermoform, molded plastic. Further, in addition, the use of insulating material allows the possibility of keeping the beverage containers cool for a long time. Also, since there is no drainage provided within the primary bucket, the cold water formed from the melting of ice is not drained out of the multipack and therefore further assists in keeping the containers cool.

While the closing wrap 300 of current disclosure has been disclosed in reference to the primary container 200 of the current disclosure. it may also be used as an independent self-sustaining unit. Further it can be integrated with various suitable multipack containers known in the art including various carton formed from foldable blank as well as cartons constructed of materials such as fabric, woven material, non-woven material, woven metallic fabric that may include ferrous or nonferrous metals, etc., or any other suitable material. In such embodiments too, the closing wrap 300 with an integrated handle of the current disclosure may be used to securely carry the multipack 100 without deviating the scope of the current disclosure.

Further, while the currently illustrated exemplary multipacks discloses a single handle having a grip portion extending out of one of the sidewalls. It is to be contemplated that any number of handles having any number of fixation portions, on any of the wall of the container including the top wall and the bottom wall may be realized in accordance with the design constraints without deviating from the scope of the current disclosure.

We claim:

1. A multipack comprising containers, the multipack comprising:

a substantially rigid primary container comprising a top open housing holding the containers, the housing comprising a bottom surface and a plurality of sidewalls extending upwardly from the bottom surface to define an inner space there between, the top open housing comprising a top open surface through which access to the containers is provided for removing the containers from the multipack;

a closing wrap closing the top open surface of the top open housing of the primary container, the wrap comprising a plurality of panels defining a first end panel connected to a second end panel through a bottom panel at one end and extending towards a top panel at another end;

wherein the closing wrap is wrapped around the housing in a vertical direction, the top panel of the wrap sealingly closing the housing from the top, and wherein each of the sidewalls of the housing has a height substantially greater than the height of the containers stored there within.

2. The multipack of claim 1, wherein the closing wrap is formed of a foldable carton blank.

3. The multipack according to claim 1, wherein the bottom panel of the foldable closing wrap is configured to be glued to a bottom surface of the housing at an outer surface thereof.

4. The multipack according to claim 1, further comprising a handle configured and/or affixed onto the top panel of the closing wrap.

5. The multipack according to claim 1, wherein the top panel is a multilayer structure comprising a top layer and a bottom layer, the bottom layer being configured to face towards the interior of the housing.

6. The multipack according to claim 5, wherein the bottom layer of the top panel comprises a plurality of holes for supporting the containers at their neck portion.

7. The multipack according to claim 1 further comprising an insert body configured to be affixed on an inner surface of the top panel.

8. The multipack of claim 7, wherein the insert body is a cushion body for stabilizing the containers stored within the primary container.

9. The multipack according to claim 7, wherein the insert body comprises a plurality of holes for supporting the containers at their neck portion.

10. The multipack according to claim 1, wherein the primary container comprises a plurality of spaced apart depressions configured onto the bottom surface of the housing wherein further each of the depression is shaped in accordance with the bottom surface of the containers.

11. The multipack according to claim 1, wherein the housing is made of a material selected from one or more of an injection molded plastic, a metal tin, and a paper thermoform.

12. The multipack according to claim 1, where in the housing comprising one or more handle openings configured on at least a pair of opposite side walls for facilitating handling of the primary container and/or the multipack.

13. The multipack according to claim 1, wherein the primary container further comprises one or more spacer trays having a plurality of cutouts, wherein the cutouts horizontally support the plurality of containers together within the housing, and the second end panel further comprises a closing flap configured to be complementary engaged with the top panel, thereby locking the closing wrap onto the primary container, wherein the closing wrap further includes an additional flap extending away from the closing flap, wherein the additional flap is folded inwardly into the primary container housing, thereby putting pressure on the spacer tray to avoid that it moves upwardly.

14. The multipack according to claim 13, wherein each of the plurality of cutouts have a diameter equal to a diameter at a position of the container at a height corresponding to the position of the spacer tray.

15. The multipack according to claim 1, wherein the each of the plurality of panels of the closing wrap has a shape and a dimension complementary to a shape of the corresponding surfaces of the housing of the primary container.

16. The multipack according to claim 13, wherein the closing flap comprises an engagement means configured to engage with the top panel, the engagement means being selected from one or more of glue based affixation, notch-based engagement, and adhesive patch.

17. The multipack according to claim 1, wherein the multipack further comprises two spacer trays having a plurality of cutouts configured to horizontally support the plurality of containers, the two spacer trays being vertically spaced apart, wherein each of the spacer trays is of a dimension the same as the inner dimension at a point of contact with the housing.

18. The multipack according to claim 1, wherein the multipack further comprises two spacer trays having a plurality of cutouts configured to horizontally support the plurality of containers, wherein the container is a bottle-shaped container having a bottom surface extended towards a neck portion through a shoulder portion, and wherein a first of the spacer trays is installed at the bottom of the housing and other at the neck portion, the two spacer trays preferably being vertically interconnected via a number of crosslinks.

* * * * *